United States Patent [19]

Williamson

[11] 4,429,755

[45] Feb. 7, 1984

[54] DRILL WITH POLYCRYSTALLINE DIAMOND DRILL BLANKS FOR SOFT, MEDIUM-HARD AND HARD FORMATIONS

[76] Inventor: Kirk E. Williamson, P.O. Box 8156, Corpus Christi, Tex. 78412

[21] Appl. No.: 237,971

[22] Filed: Feb. 25, 1981

[51] Int. Cl.[3] ..... E21B 10/46; E21B 10/60

[52] U.S. Cl. ..... 175/329; 175/314; 175/393; 175/410

[58] Field of Search ..... 175/408, 413, 312, 314, 175/329, 410, 327, 421, 393

[56] References Cited

U.S. PATENT DOCUMENTS

| | | | |
|---|---|---|---|
| 2,201,219 | 5/1940 | Bell | 175/408 X |
| 2,838,284 | 6/1958 | Austin | 175/329 |
| 2,898,086 | 8/1959 | Freeman, Jr. et al. | 175/312 |
| 3,071,201 | 1/1963 | Phipps | 175/410 |
| 3,693,735 | 9/1972 | Cortes | 175/329 |
| 3,825,083 | 7/1974 | Flarity et al. | 175/329 |
| 4,244,432 | 1/1981 | Rowley et al. | 175/329 |
| 4,246,977 | 1/1981 | Allen | 175/329 |
| 4,253,533 | 3/1981 | Baker | 175/410 |

FOREIGN PATENT DOCUMENTS

| | | | |
|---|---|---|---|
| 2309168 | 9/1973 | Fed. Rep. of Germany | 175/410 |
| 791889 | 12/1980 | U.S.S.R. | 175/410 |

*Primary Examiner*—Stephen J. Novosad
*Assistant Examiner*—Joseph Falk
*Attorney, Agent, or Firm*—Penrose L. Albright

[57] ABSTRACT

Drill bit for drilling bore holes in earth formations, the bit's cutting face provided with cutter preforms composed of polycrystalline diamonds on a tungsten carbide substrate mounted in sets from the center of the bit's face to its periphery. The first set consists of one cutter preform at approximately the center of the cutting face. Each succeeding set has at least two preforms, all of which in a set are disposed at an equal radius from the bit's axis of rotation and are displaced from adjacent preforms in the same set by equal arcs around the axis, the cutting path of a set overlapping with that of the next set. The next to last set of preforms is mounted from a surface coinciding with a truncated cone having a relative angle to the bit's axis of rotation of about 33°; the outermost preform set is disposed in or above the junk slots, with each preform mounted extending 90° relative to the axis of rotation and having its cutting portion extending above raised portions from the cutting face whereby they cut a circumference slightly larger than that of the bit's body. Four to six jets for drilling mud have outlets from the drilling face, each jet including a relatively narrow neck and flared mouth. Junk slots are defined by the raised portions, a first group of such portions in one embodiment being stepped inwardly to form off-sets adjacent the conical surface of the bit's face. A second group of portions in such embodiment which alternate with the first extend somewhat less outwardly than the bit's overall diameter and each has a length less than one-half of the length of those of the first group. The bit's overall diameter is approximately twice its length along the first group of raised portions.

31 Claims, 9 Drawing Figures

Table I

| No. OF OPENINGS | RADIUS | α REF. | ANGLE COUNTER-CLOCKWISE FROM Y-AXIS OF EACH CENTERLINE 48 | CIRCLE No. |
|---|---|---|---|---|
| 1 | .3254 | 3.54606° | 180° | |
| 2 | .6701 | 7.27076° | 90°, 270° | 50 |
| 2 | 1.0620 | 11.42479° | 45°, 225° | 51 |
| 2 | 1.4684 | 15.59926° | 15°, 195° | 52 |
| 4 | 1.8809 | 19.6577° | 82°, 172°, 262°, 352° | 53 |
| 4 | 2.2968 | 23.54162° | 60°, 150°, 240°, 330° | 54 |
| 4 | 2.7154 | 27.21963° | 15°, 105°, 195°, 285° | 55 |
| 8 | 3.1171 | ⊥ TO 56.7° SEE X | 0°, 45°, 90°, 135°, 180°, 225°, 270°, 315° | 56 |
| 8 | 3.3432 | ⊥ α SEE T | 22.5°, 67.5°, 112.5°, 157.5° 202.5°, 247.5°, 292.5°, 337.5° | 57 |

Table II

| No. OF OPENINGS | RADIUS | α REF. | ANGLE COUNTER-CLOCKWISE FROM Y-AXIS OF EACH CENTERLINE 48 | CIRCLE No. | RAKE ANGLE |
|---|---|---|---|---|---|
| 1 | .3254 | 3.554° | 180° | | |
| 2 | .6701 | 7.333° | 90°, 270° | 50B | 7.5 |
| 2 | 1.082 | 11.894° | 45°, 225° | 51B | 7.5 |
| 2 | 1.4884 | 16.469° | 15°, 195° | 52B | 7.5 |
| 4 | 1.9009 | 21.227° | 82°, 172°, 262°, 352° | 53B | 5 |
| 4 | 2.3168 | 26.187° | 60°, 150°, 240°, 330° | 54B | 5 |
| 4 | 2.7354 | 31.401° | 45°, 135°, 225°, 315° | 55B | 5 |
| 4 | 3.0971 | (1) | 30°, 120°, 210°, 300° | 56B | 0 |
| 6 | 3.511 | (2) | 43°, 103°, 163°, 223°, 283°, 343° | 57B | −5 |
| 8 | 3.72 | T α SEE T | 22.5°, 67.5°, 112.5°, 157.5°, 202.5°, 247.5°, 292.5°, 337.5° | 58B | −5 |

(1) ⊥ TO 56.7° SEE X
(2) ⊥ TO 56.7° SEE X

DRILL WITH POLYCRYSTALLINE DIAMOND DRILL BLANKS FOR SOFT, MEDIUM-HARD AND HARD FORMATIONS

BACKGROUND OF THE INVENTION

The invention relates to a rotary drill bit for drilling oil and gas wells and, more particularly, to a drill bit suitable for up to hard formations having cutting preforms of polycrystalline diamonds on tungsten carbide substrates.

In rotary drilling, the bit is fixed on the end of a rotating drill pipe inside a casing, the drill pipe being lowered as the drilling progresses. A heavy artificial substance known as drilling mud is circulated down through the drill pipe, out through the bit and back up the casing to remove rock fragments. The drilling mud cools the bit, washes the cutting elements so they present a clean cutting face whereby the cutting takes place and, as indicated, lifts or carries debris resulting from the drilling to the surface. For the drilling mud to carry out these functions, it is necessary its velocity through the bit's fluid entrances and channels be high without causing an undesirably high back pressure so it moves quickly across the face and is discharged rapidly and efficiently up the junk slots. It is important clogging of the bit be prevented with rapid removal of cuttings and also that undue stress be avoided.

Rapid penetration of the earth and longer runs improve efficiency of the drilling operation very substantially. Preform cutting elements as disclosed in U.S. Pat. Nos. 3,745,623, 3,767,371, 4,109,737 and 4,156,329 have been utilized by the inventor and others to provide improved penetration in soft to medium-hard formations such as salt, shale, anhydrite, carbonates, marls, clay and sandstones. But when drilling in harder formations, difficulties have been encountered. Solutions to such problems have been suggested as disclosed, for example, in U.S. Pat. No. 4,006,788 to L. Garner, which applies to a rotary drill bit provided with rolling cone cutters. The patent spells out the need for rotary rock bits which work well in various types of formations, soft or hard, encountered in deep wells where it is highly desirable to penetrate long distances before changing the bits required.

SUMMARY OF THE INVENTION

The invention primarily involves the arrangement of the cutter preform elements, the shape of the drilling face, the relative proportions of the bit body, the structure of the fluid entrances, and the location and relative size of the junk slots to achieve a rock drill capable of relative rapid penetration in deep wells irrespective of the formations encountered. The bit, provided with cutter preform elements of polycrystalline diamonds with tungsten carbide substrates penetrates relatively rapidly for the formation involved with a relatively lengthy drilling time whereby costs per foot drilled are significantly reduced.

A major aspect of the invention lies in the arrangement of the cutter preforms in sets, the cutter preforms on each given set being disposed at equal radius from, and displaced about, the axis of rotation of the bit through equal arcs. Successive sets of cutter preforms remove the formation through which they are penetrating by cutting or shearing action, each set tracing a path which overlaps with the paths of the adjacent set or sets. The peripheral set of cutter preforms is secured within or adjacent to the junk slots and off-sets may be provided in alternately adjacent raised portions which both protect cutter preforms and ensure junk slots remain unclogged. Clogging is also minimized by proportions of the bit body wherein the overall diameter of the body is about twice its length measured along the raised portions which define the junk slots. The fluid entrances from the interior of the bit to its drilling face are of a converging-diverging type constructed from two components, a converging shaped jet element held in place by diverging jet holder component, the combined jet nozzle minimizing flow turbulence, erosion and corrosion which would otherwise result from sharp cornered and straight-necked nozzles.

Strong, but not larger than required, supports for cutter preform elements aid in minimizing resistance of flow of the drilling mud away from the drilling face. A relatively rearward inclination of about 20° relative to a line perpendicular to the drilling face through the axis of the cutter preform element improves its impact resistance whereby energy required to remove a given amount of formation is substantially reduced.

Other objects, adaptabilities and capabilities of the invention will be appreciated by those skilled in the art as the description progresses, reference being had to the accompanying drawings, in which:

DESCRIPTION OF THE PREFERRED EMBODIMENTS

Figure 1:
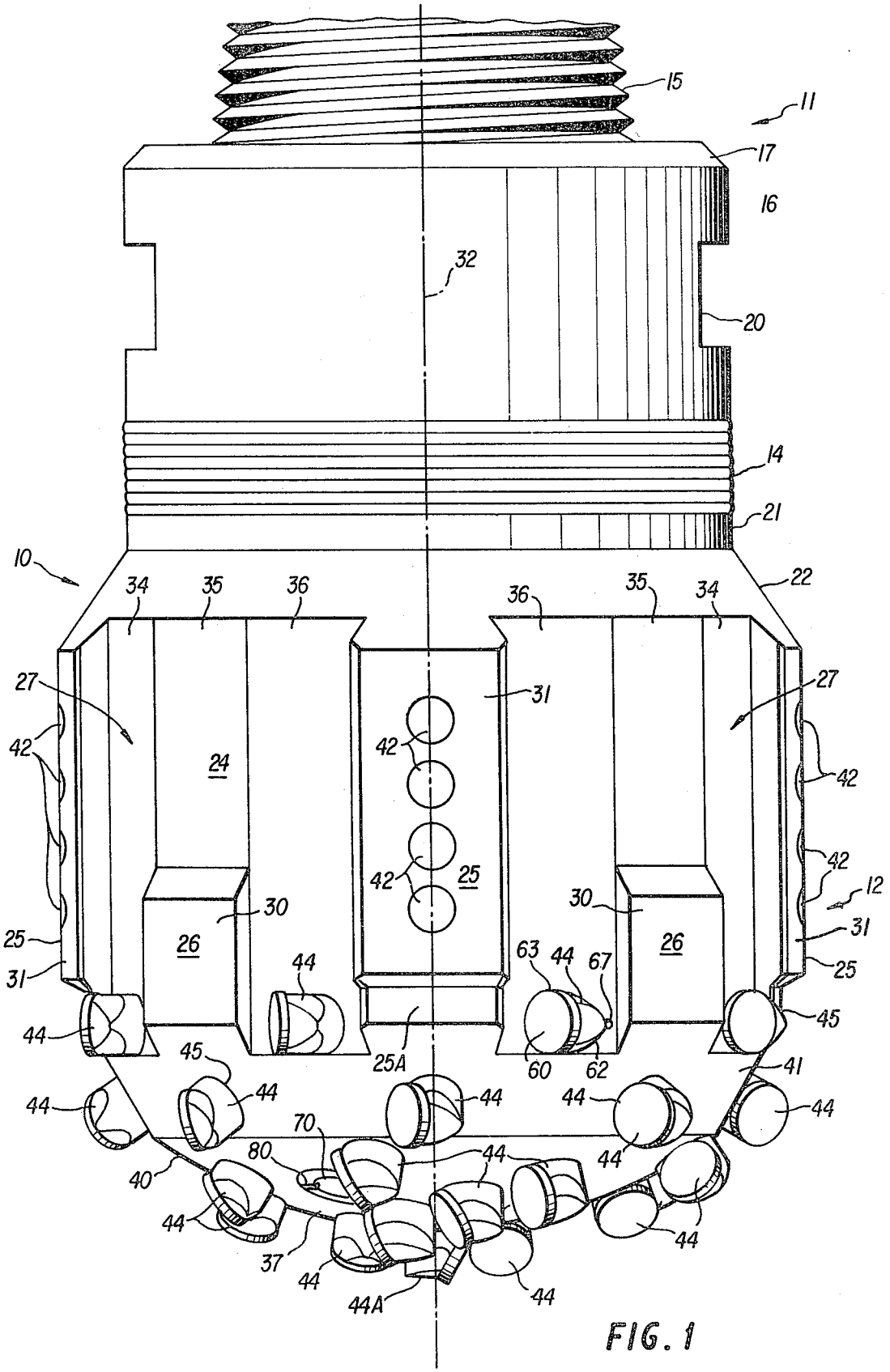
FIG. 1 is a side elevation of a drill bit in accordance with the invention.

Referring to the drawings, the drill bit indicated generally by reference numeral 10 which consists of a pin shank 11 and a crown 12 rigidly connected by a weld 14.

Pin shank 11 includes a threaded connection 15 integral with a steel shank 16 which includes a shank angle 17 and a breaker slot 20, also known as a keyway, for threading drill bit 10 onto the end of a rotating drill pipe not shown.

Crown 12 has a further shank portion 21 which, by weld 14, and internally threaded is rigidly affixed to shank 16 and forms a part thereof. Integral with shank portion 21 is the angle shoulder 22. Below shoulder 22 (to its left as seen in FIG. 1) is a side surface 24 which includes four raised portions 25 and a further set of raised portions 26 which alternate with portions 25. The latter raised portions 26 are each surrounded on three sides by a fluid channel known as a junk slot 27. Portions 26 have planar outboard surfaces 30 contrasting with the curved outboard surfaces 31 of each raised portion 25, each such surface 31 coinciding with a cylindrical surface having the same longitudinal axis as the bit's axis of rotation 32. Between adjoining portions 25, slots 27 have three adjoining planar surface strips 34, 35 and 36, the central strips 35 having the same width as the innermost parts of the corresponding portion 26. The bit's face 37 has a central convex portion 40 surrounded by a peripheral portion 41, portion 40 coinciding with a portion of a sphere having its center on the axis 32 and the portion 41 coinciding in part with a cone having its apex and longitudinal axis coinciding with axis 32.

Each raised portion 25 is provided with four gauge buttons 42 which are composed of tungsten carbide and press fitted in portions 25 flush with their outboard surfaces.

Figure 2:
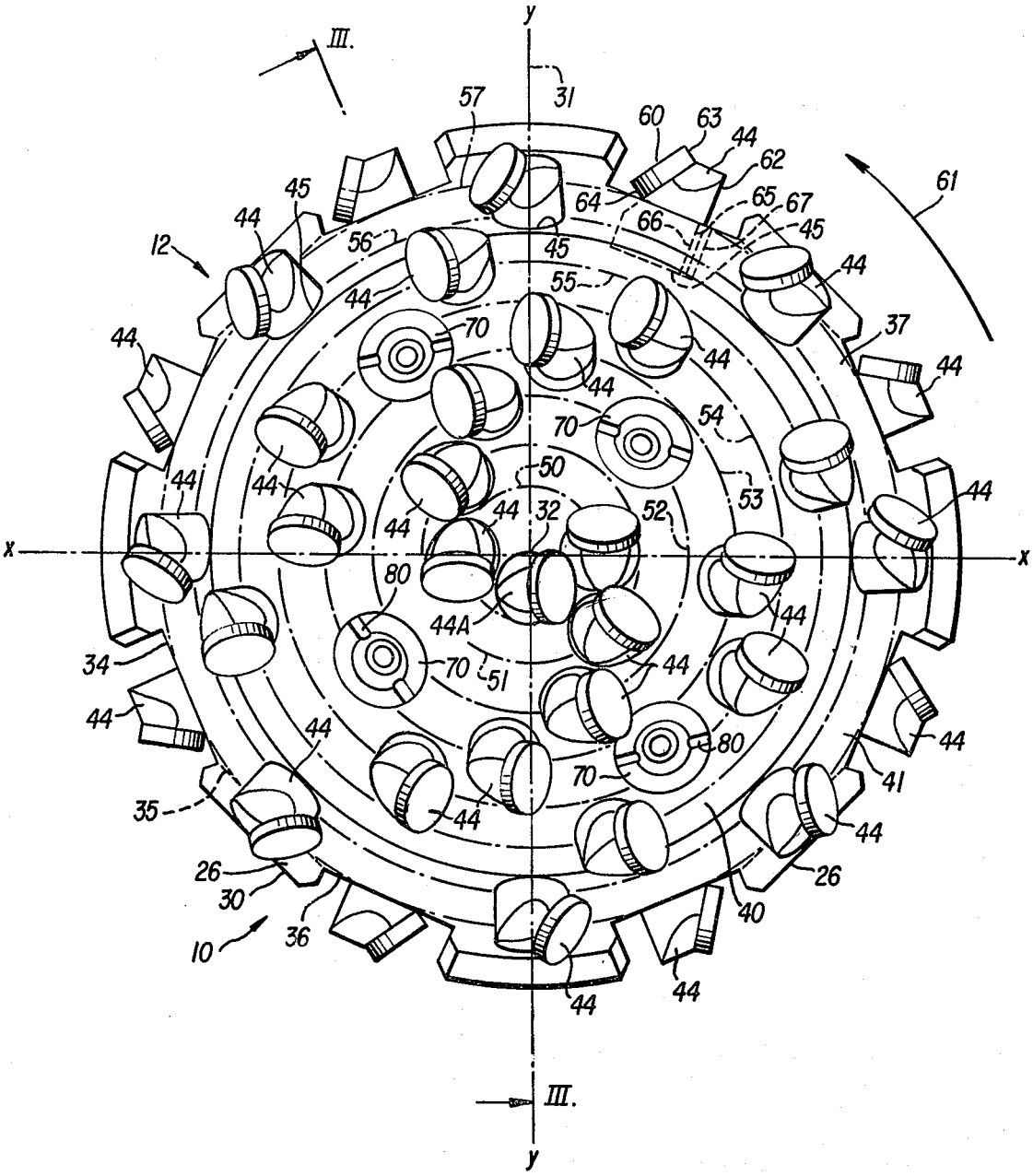
FIG. 2 is a bottom view, in the operational sense, of the drill bit shown in FIG. 1.
Figure 7:
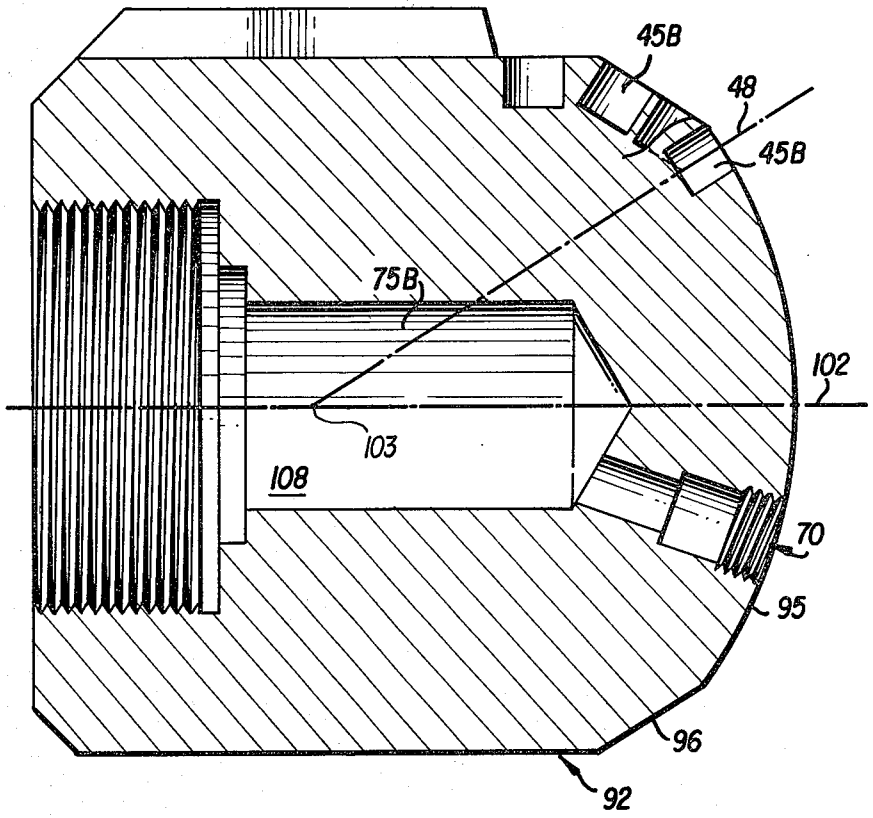
FIG. 7 is a sectional view of the crown of the bit of FIGS. 5 and 6 taken on section lines 7—7 of FIG. 6.

From FIG. 2, it will be noted that nineteen preform cutter elements are mounted on face portion 40, eight further preform elements 44 are mounted on conical portion 41 and a still further eight preform cutter elements 44 are mounted in junk slots 27 between each raised portion 26 and its succeeding raised portion 25 adjacent face portion 41. Thus, there are total of twenty-seven preform cutter elements 44 which are mounted on the bit's face 37 and eight further elements 44 are mounted in junk slots 27, for a total of thirty-five cutter elements mounted on crown 12.

As seen in FIG. 2 the most central cutter element designated 44A has an edge which coincides with axis of rotation 32 and succeeding sets of cutter elements 44 are received in successive sets of openings 45 which have their centers coincide with circles 50, 51, 52, 53, 54 and 55, respectively, on face portion 40, and circle 56 on face portion 41, succeeding circles 50 through 56 being shown in dot-dash lines and representing generally the cutting paths of successive sets of cutter elements 44. Commencing after cutting element 44A it will be noted the next three sets, for circles 50, 51 and 52, each have two cutter elements 44 whereas the next successive three sets, coinciding with circles 53, 54 and 55, respectively, each have four cutter elements 44. The last successive set of eight cutter elements 44 on face portion 40 coincides with circle 56. Finally, the last set of cutter elements 44 have the center of their cutting blanks 60 rotate through the circle 57 which, as seen in FIG. 2, is tangent to strips 34 and 36. A circle (not shown) through the centers of the faces of cutting blank 60 coincides with the outboard surfaces of the offset cylindrical portions 25A of each raised portion 25.

Figure 3:
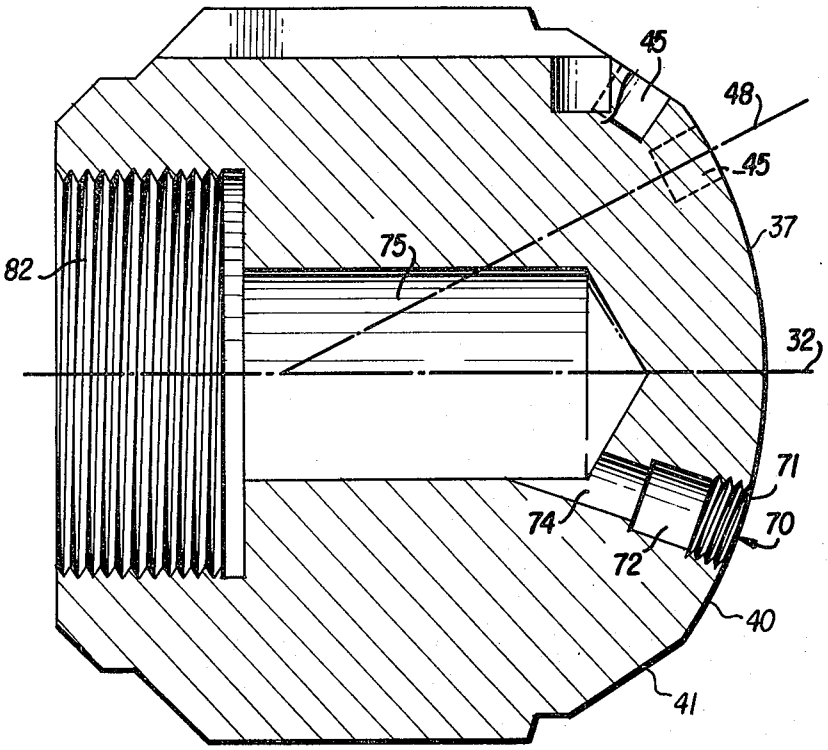
FIG. 3 is a side sectional view taken on section lines III—III of FIG. 2.

As seen in FIG. 3, it will be appreciated each circle 50-55 passes through a centerline 48 at the corresponding surface of the face portion 40 whereby the centerline 48 intersects axis 32 at the same point as the radius for face portion 40. In the following Table I this angle is indicated by the angle alpha ($\alpha$). The radius of each circle 50 through 57 is also shown in Table I for succeeding circles together with the number of openings 45 and the angle from the Y axis as seen in FIG. 2 in a counterclockwise direction indicated by arrow 61, the operational direction of rotation of the bit, the angle of the intersection of each centerline with a corresponding circle 50 through 57 being also included in Table I.

TABLE I

| No. OF OPENINGS | RADIUS | $\alpha$ REF. | ANGLE COUNTER-CLOCKWISE FROM Y-AXIS OF EACH CENTERLINE 48 | CIRCLE No. |
|---|---|---|---|---|
| 1 | .3254 | 3.54606° | 180° | |
| 2 | .6701 | 7.27076° | 90°, 270° | 50 |
| 2 | 1.0620 | 11.42479° | 45°, 225° | 51 |
| 2 | 1.4684 | 15.59926° | 15°, 195° | 52 |
| 4 | 1.8809 | 19.6577° | 82°, 172°, 262°, 352° | 53 |
| 4 | 2.2968 | 23.54162° | 60°, 150°, 240°, 330° | 54 |
| 4 | 2.7154 | 27.21963° | 15°, 105°, 195°, 285° | 55 |
| 8 | 3.1171 | ⊥ TO 56.7° SEE X | 0°, 45°, 90°, 135°, 180°, 225°, 270°, 315° | 56 |
| 8 | 3.3432 | ⊥ $\alpha$ SEE T | 22.5°, 67.5°, 112.5°, 157.5° 202.5°, 247.5°, 292.5°, 337.5° | 57 |

Cutter blank 60 is made of a combination of polycrystalline (man made) diamonds and cemented tungsten carbide produced as an integral blank by a high-temperature, high pressure process developed by General Electric Company and currently marketed under the trademark "STRATAPAX." The particular blank is identified by General Electric's product No. 2542. Cutting elements of the type involved are disclosed in U.S. Pat. No. 4,109,737 of H. Bovenkerk which issued Aug. 29, 1978.

Cutting blank 60 is mounted on a pin 62 and is bonded to a bias part 64 which is canted 20 degrees to the rearward relative to the centerline pin 62, the opening 45 receiving pin 62.

Each cutter element 44 has at the rear of pin 62 a channel 65 which defines part of an opening 66, the other portion of opening 66 being defined in the crown 12 as shown. Such opening 66 receives a lock pin 67 for maintaining each cutter element 44 in the desired rake alignment.

To insert each cutter 44, the material surrounding opening 45 is heated to a range of 1800° to 1900° F. and cutter element 44 is pressed into the opening 45 until the disc 63, on which cutting blank 60 is mounted, is pressing on the surface of the crown 12 with the channel 65 being aligned to define opening 66. The objective is to achieve a tight shrink-press fit combination. With the opening 66 properly aligned, lock pin 67 is pressed into place and the next cutter element 44 is placed in appropriate opening 45, by the same process, the sequence of openings and time for inserting each cutter element being such the temperature of face 37 does not exceed 1250° F. except in the immediate vicinity of the opening 45 involved.

Figure 4:
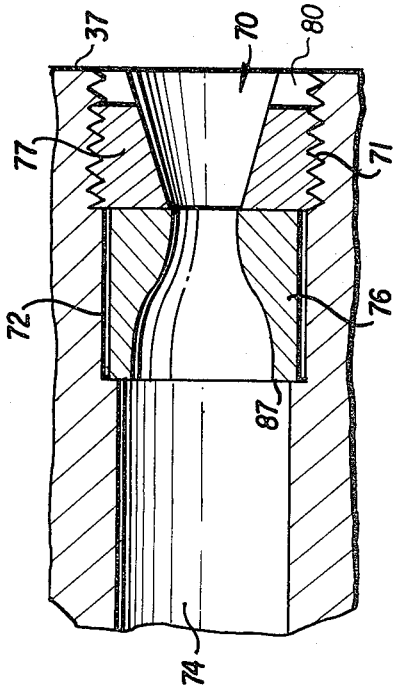
FIG. 4 is a detail sectional view of a jet insertion taken on section lines IV—IV of FIG. 2.
Figure 5:
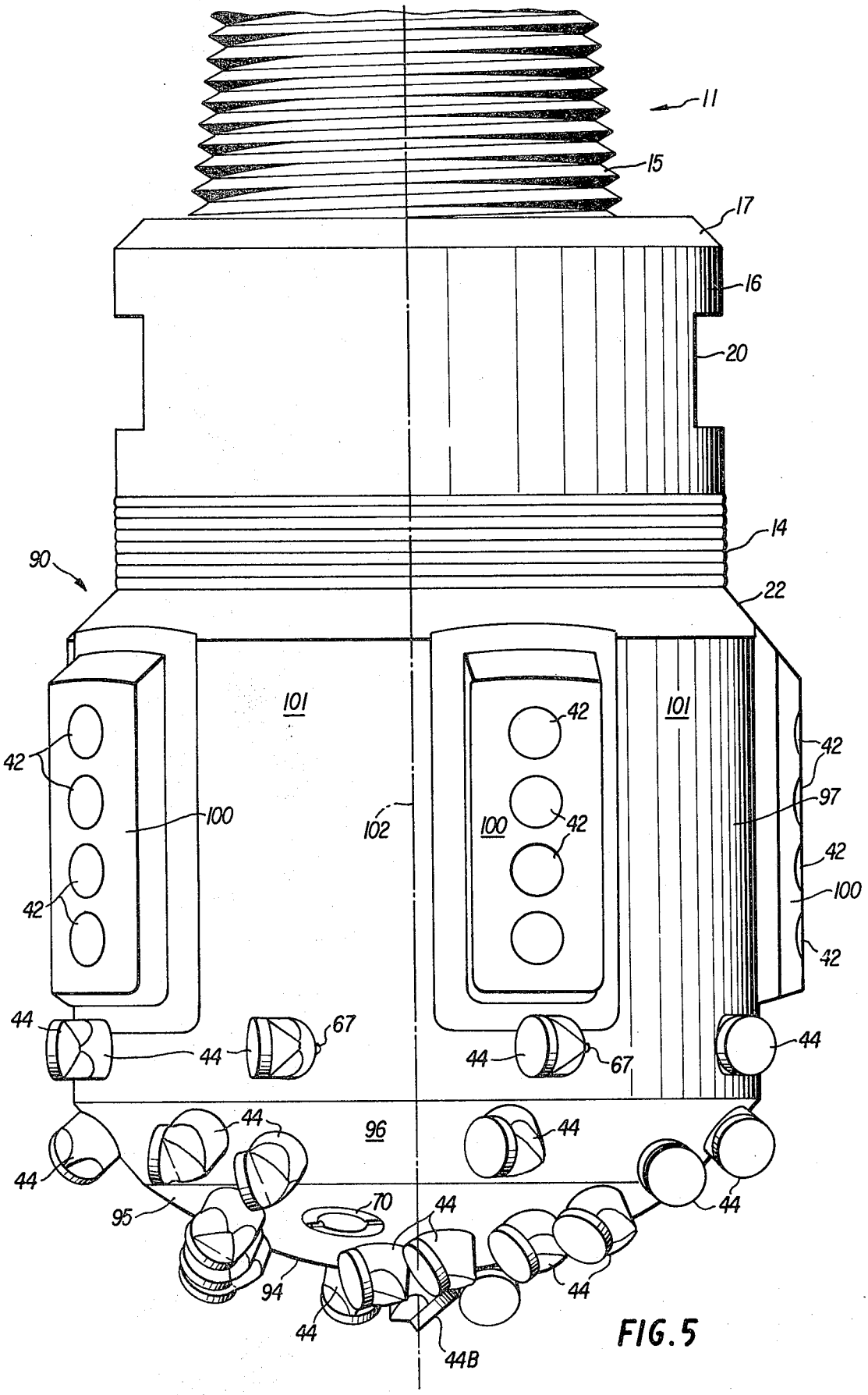
FIG. 5 is a side elevation of a further embodiment of a drill bit in accordance with the invention.

Referring to FIG. 4, a jet opening for supplying drilling mud in face 37 is shown. It will be noted from FIG. 2 there are four such jet openings 70. Each opening 70 has a threaded portion 71, and an enlarged portion 72 and a bore 74 which connects with fluid entrance 75.

Enlarged portion 72 receives a nozzle throat 76 which is sealed in portion 72 by a high temperature sealant such as, for example, the Haliburton "Howcoweld." A nozzle flared piece 77 is received in the threaded portion 71 and also sealed in place by a high temperature sealant such as Haliburton's "Howcoweld." It will be noted nozzle piece 77 includes a pair of notches 80 for receipt of a tool for turning piece 77 whereby it is received by threaded portion 71 and nozzle throat 76 is firmly seated against shoulders 81 which are disposed between bore 74 and enlarged portion 72.

Preferably, the surface of the drill bit 10 is case hardened to minimize undesirable scarring of the bit during operation.

In field tests, drill bits constructed in accordance with the invention have operated as follows:

| TEST NO. | STRATA | FEET DRILLED | HRS. DRILLED | COST/FT. |
|---|---|---|---|---|
| 1 | Shale and sand | 1766 | 47.5 | $20.10 |
| 2 | Shale | 1499 | 40 | $22.10 |
| 3 | Shale | 1520 | 48.3 | $23.72 |

The following observations were made from field tests:

1. Retention of cutting elements in the drilling bit was excellent;
2. The bit operated very well in strata of all types including hard strata.
3. The cost per foot drilled by drilling bits in accordance with the invention compared with conventional bits frequently provides savings in the range of fifty to one hundred percent.
4. The effective life of the bit for hard formations is about forty-eight hours in which period roughly a penetration of 1500 to 1800 feet can be reasonably anticipated.
5. The wear on individual cutter elements increased as their distance from the axis of rotation increased.
6. There was a need to increase the flow areas for the drilling mud to minimize loss of effective jet action.
7. Recirculation of junk in the drilling mud can be a source of difficulty and should be minimized.

As a result of the foregoing observations, modifications were incorporated in the bit whereby the further embodiment illustrated in FIGS. 5 through 9 was constructed. This drill bit, designated generally by reference numeral 90, has a pin shank 11 which is essentially the same as that of the first embodiment. Here and with other components similar to those in the first embodiment, the same reference numerals are used. Thus, in crown 92 of drill bit 90, gauge buttons 42 and preform cutter elements 44 are essentially identical to those shown in the first embodiment. However, it will be recognized the placement of such elements on crowns 12 and 92 is different.

Crown 92 includes a bit face 94 which has a convex portion 95 and a conical portion 96 which coincides with the surface of a truncated cone.

The cylindrical sides or surface 97 of crown 92 have five raised portions 100 welded thereto. Such raised portions including four openings each receiving gauge buttons 42. Thus with five raised portions 100, twenty gauge buttons 42 are required. Preferred are serrated compact General Electric type gauge buttons (No. 59S3AH) which are pressed to be flush with the surface.

The spaces between raised portions 100, which are identified by reference numerals 101, function as junk slots and it will be noted raised portions corresponding to portions 26, as shown in the first embodiment, have been eliminated in this embodiment. The area of spaces 101 is roughly double that of portions 100. The purpose is to maximize space provided for discharge of drilling mud while retaining sufficient surface through raised portions 100 to maintain drill bit 90 in its proper location relative to the shaft which is being carved out by the drill bit.

The axis of rotation of drill bit 90 is axis 102. Convex portions 95 of face 94 has a radius of 5.25 inches from a point on axis 102. The diameter of surface 97 is 7.45 inches and the radius of portion 95 as seen from above is 2.99 inches. The overall diameter of the crown 92, considered as a cylinder coinciding with the surfaces of raised portions 100, is 8.467 inches. However, it will be noted from FIG. 6 the preform cutter elements farthest from axis 102 circumscribe a circle having a diameter of 8.495 inches. Thus, the tops of the outmost cutting blanks 60, as manufactured, cut an opening somewhat larger than the diameter circumscribed by the outer surfaces of raised portions 100.

Figure 6:
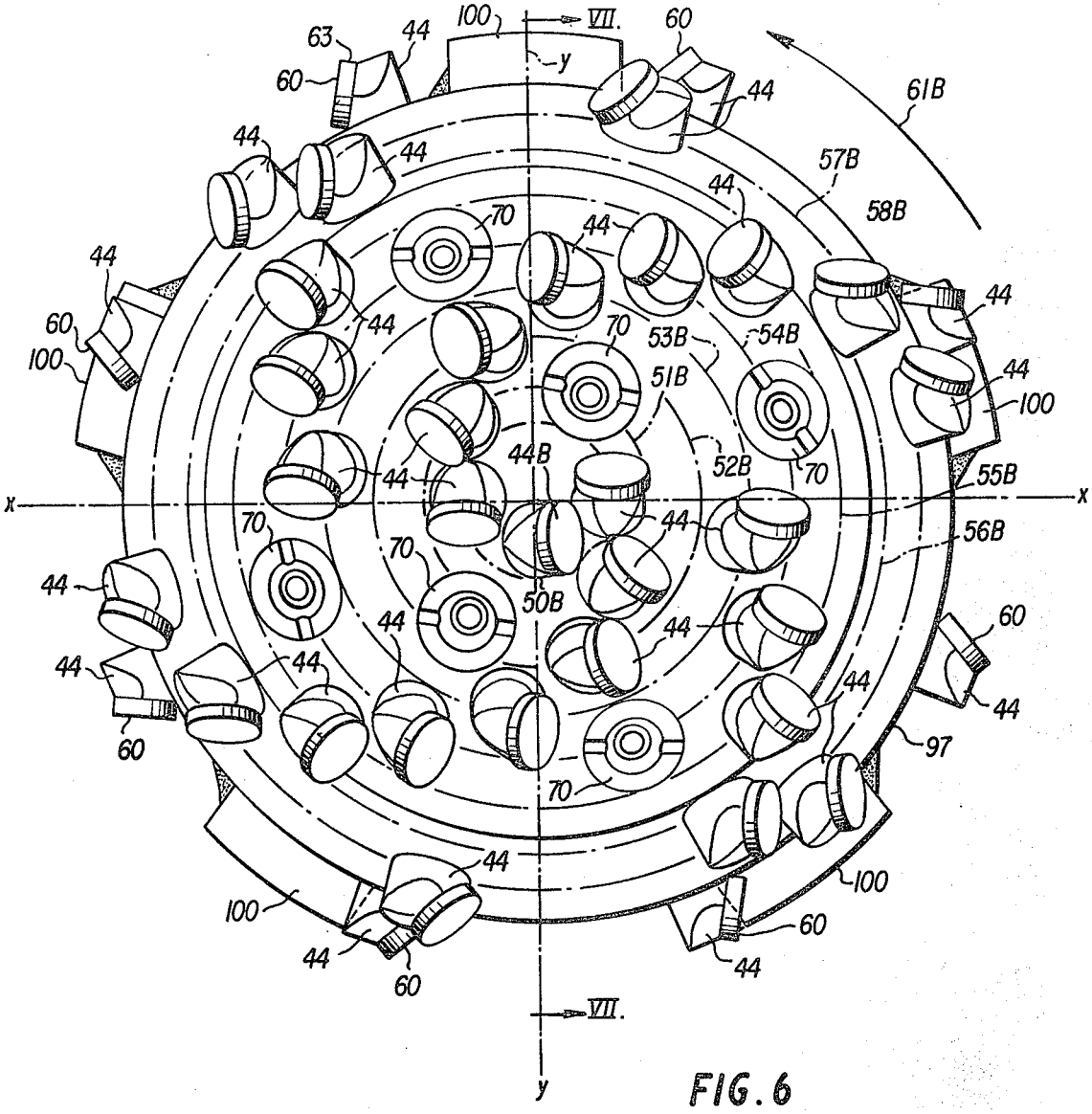
FIG. 6 is a view, similar to FIG. 2, of the embodiment shown in FIG. 5.

The precise locations of preform cutter elements 44 on crown 92, as shown in FIG. 6, are set forth in the following Table II:

TABLE II

| No. OF OPENINGS | RADIUS | α REF. | ANGLE COUNTER-CLOCKWISE FROM Y-AXIS OF EACH CENTERLINE 48 | CIRCLE No. | RAKE ANGLE |
|---|---|---|---|---|---|
| 1 | .3254 | 3.554° | 180° | | |
| 2 | .6701 | 7.333° | 90°, 270° | 50B | 7.5 |
| 2 | 1.082 | 11.894° | 45°, 225° | 51B | 7.5 |
| 2 | 1.4834 | 16.469° | 15°, 195° | 52B | 7.5 |
| 4 | 1.9009 | 21.227° | 82°, 172°, 262°, 352° | 53B | 5 |
| 4 | 2.3168 | 26.187° | 60°, 150°, 240°, 330° | 54B | 5 |
| 4 | 2.7354 | 31.401° | 45°, 135°, 225°, 315° | 55B | 5 |
| 4 | 3.0971 | (1) | 30°, 120°, 210°, 300° | 56B | 0 |
| 6 | 3.511 | (2) | 43°, 103°, 163°, 223°, 283°, 343° | 57B | −5 |
| 8 | 3.72 | T α SEET | 22.5°, 67.5°, 112.5°, 157.5° 202.5°, 247.5°, 292.5°, 337.5° | 58B | −5 |

(1) ⊥ TO 56.7° SEE X
(2) ⊥ TO 56.7° SEE X

Comparison of Table II with Table I reveals that following the most central cutter element 44A in FIG. 2 and 44B in FIG. 6, there are eight additional sets of cutter elements 44 in FIG. 2 whereas in FIG. 6 there are nine additional sets of cutter elements 44, such sets being in corresponding circles 50B through 58B. In Table II, the radius of each circle 50B through 58B is measured perpendicular to axis 32. The angle A-1 is the number of degrees from the Y axis as seen in FIG. 6 in a counterclockwise direction indicated by arrow 61B, also the operational direction of the bit, where such angle intersects with centerline 48 for each cutter element 44 in a corresponding circle 50B through 58B. In addition, as will be understood by reference to FIG. 9, the rake angle of the elements faces (viewed along their corresponding axis 48) has been modified from zero degrees cutter elements 44 in the first embodiment to a +7½° for preform cutter elements 44 in circles 50B, 51B, and 52B, and a +5° for preform cutter elements 44 in circle 53B, 54B and 55B. Preform cutter elements 44 in circle 56B have a zero rake angle, whereas cutter elements 44 in circles 57B and 58B have a minus 5° rake angle.

In view of the foregoing, it will be appreciated as seen in FIG. 6, the most central cutter element designated 44B has an edge which coincides with the axis of rotation 102 and succeeding sets of cutter elements 44 are received in successive sets of openings 45B which have their centers coincide with circles 58B, 51B, 52B, 53B, 54B and 55B, respectively, on convex portion 95, and on circles 56B and 57B on conical portion 96. Circle 58B in this embodiment represents surface 97.

The first three sets of cutting elements 44 each have two cutter elements which are 180° apart. The next four cutter elements 53B, 54B, 55B and 56B, each have four cutter elements 44. These sets each have such cutter elements spaced 90° apart. Circle 57B has six cutter elements 44 which are spaced apart 60°. Finally, the last set of eight cutter elements 44 in circle 58B are spaced apart by 45°.

It will be further noted, whereas the first embodiment discloses four jet openings, the instant embodiment has six jet openings 70, such openings 70 being identical to those shown in FIG. 4 of the first embodiment.

From the foregoing, it will be appreciated in the second embodiment the gauge buttons have been increased from sixteen to twenty, the preform cutter elements have been increased from thirty-five to thirty-seven and the number of jet openings have been increased from four to six. The four outermost jets are centered at a radius of about 2.3168 inches from axis 102 and are spaced 90° apart. At the same time the space provided for the junk slots has also been enlarged.

Figure 8:
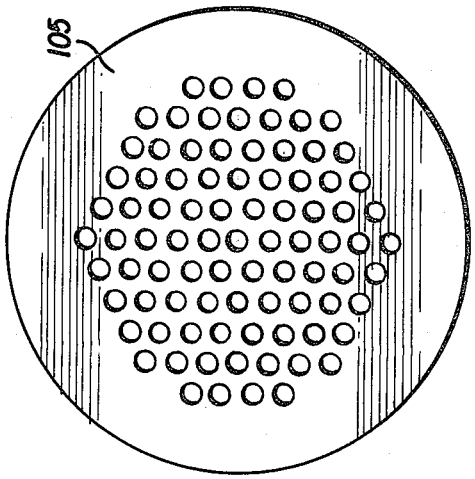
FIG. 8 is a plan view of a junk screen received in the bit's crown.
Figure 9:
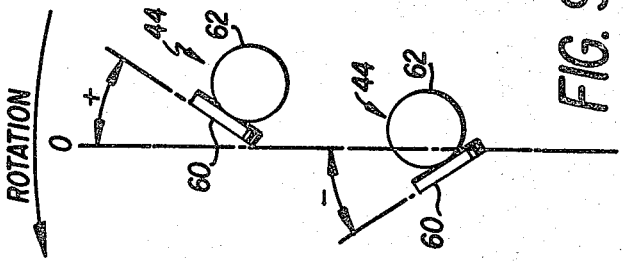
FIG. 9 illustrates the rake angles of preform cutter elements relative to the direction of rotation.

FIG. 8 discloses an optional junk screen 105 which may be optionally seated on shoulder 108 at fluid entrance 75B within crown 92 to prevent recirculation of junk in the drilling mud into fluid entrance 75B and under crown 92.

In an initial test of the second embodiment, bit 90 drilled 3204 feet in 183 continuous hours of drilling for an average of 17.51 feet per hour. It went into the hole at about 7300 feet.

In operations, the bit 10 or 90 is affixed by means of the threaded connection 15 on the end of a rotating drill pipe inside a casing, the drill pipe being lowered drilling progresses. A heavy artificial "mud" is circulated down through the drill pipe, into the bit's fluid entrances, out through the bit's jet openings, and back up via the junk slots and the casing. The accumulated junk, that is the rock fragments and the like, is filtered out before the mud is recirculated into the drill pipe and any junk missed is stopped by screen 105 on the second embodiment. A relax oil base type drilling mud with mud weight of about 12.2 to 15.4 has been used with success. The bit face velocity is in a range of about 275 to 325 feet per second.

The drawings are reasonably to scale. They are intended to disclose the relationship of the various components whether or not specifically described as such in the foregoing specification. Claim language directed to the various elements of the invention should be construed to cover corresponding structure in the specification and equivalents thereof. For example, "rake angle" of a cutter element is intended to refer to the rake angle illustrated in FIG. 9. Also, it is to be understood that although preferred embodiments of the invention have been described above, the inventive concepts may be applied to other applications and modifications within the scope of the appended claims.

Having described my invention, what I claim as new and desire to secure by Letters Patent of the United States is:

1. A drill bit for oil or gas wells which comprises a shaft, a cylindrical bit body affixed to said shaft, said bit body having a convex end surface and a side surface, said side surface including a plurality of alternating raised portions and fluid channels defined between said raised portions, a plurality of cutters rigidly mounted on said end surface, one said cutter disposed to rotate closely proximate the bit's axis of rotation, a first set of cutters each disposed at a first equal radius from said axis and every cutter in said first set displaced from its adjacent cutter or cutters in said first set through equal arcs around said axis, and further successive sets of cutters, the cutters in each said set being disposed further radii equal in each said set and all cutters in each respective set being displaced from its adjacent cutter or cutters in its said set by substantially equal arcs in each said set around said axis and having flat cutting faces which are slanted to the rear relative to their direction of rotation and otherwise generally face in said direction, said cutters tracing circular cutting paths around said axis which overlap and substantially cover the entire area of said end surface.

2. A drill bit in accordance with claim 1 wherein each said set of cutters in operation traces a path which overlaps with paths traced by the adjacent set or sets of cutters for about one-third the width of each said path.

3. A drill bit in accordance with claim 1 wherein said cutters comprise cutter preform elements composed of polycrystalline diamonds with tungsten carbide substrates.

4. A drill bit in accordance with claim 1 wherein each said cutter has a flat cutting surface which has a rearward inclination of about 20° relative to a line perpendicular to said end surface through such cutter.

5. A drill bit in accordance with claim 1 wherein said end surface comprises a convex cutting surface, jet fluid outlets provided on said convex cutting surface, said outlets being provided with a converging part followed by a diverging part whereby flow turbulence is minimized.

6. A drill bit in accordance with claim 1 comprising at least thirty-five said cutters.

7. A drill bit in accordance with claim 1 comprising at least thirty-seven said cutters.

8. A bit in accordance with claim 1 wherein at least some of said cutters have a planar cutting face which has a negative rake angle relative.

9. A drill bit in accordance with claim 8 wherein said negative rake is in a range of 0° to 10°.

10. A drill bit in accordance with claim 1 wherein at least some of said cutters have a planar face which has a positive rake angle relative.

11. A drill bit in accordance with claim 9 wherein said positive rake angle is between 0°–10°.

12. A drill bit for oil wells or the like which comprises a shaft, a cylindrical bit body affixed to said shaft, said bit body having an end surface and a side surface, said side surface including a plurality of alternating raised portions and fluid channels defined between said raised portions, said alternate raised portions having a stepped inwardly offset portion proximate said end surface said offset portion's radius from the bit's axis of rotation being greater than the distance from said axis to the bottoms of each said channel and less than the outermost radius of each said raised portion from said axis.

13. A drill bit for oil wells and the like which comprises a shaft, a cylindrical bit body affixed to said shaft, said bit body having an end surface and a side surface, said side surface including a plurality of alternating outermost extending raised portions and vertically disposed fluid channels defined between said raised portions, cutters extending from said bit body, said cutters each having planar cutting faces which are substantially parallel to the drill bit's axis of rotation, each said cutter being disposed at the inlet of each of said channels.

14. A drill bit in accordance with claim 13 wherein said cutters comprises preform cutter elements composed of polycrystalline diamonds on tungsten carbide substrates.

15. A drill bit in accordance with claim 13 wherein each said cutter's planar cutting face is inclined to the rear at an angle of about 20° relative to the immediate underlying surface.

16. A drill bit in accordance with claim 13 wherein each said cutter's planar cutting face has a negative rake angle.

17. A drill bit in accordance with claim 13 wherein there are at least two cutters in each said channel.

18. A drill bit which comprises a shaft, a cylindrical bit body affixed to said shaft, said bit body having an end surface and a side surface, said side surface including a plurality of alternating raised portions and fluid channels, said fluid channels defined between said raised portions, at least one cutter disposed at the inlet of one of said fluid channels, the cutting face of said cutter being substantially parallel to the axis of rotation of the drill bit, the largest width of said bit body being approximately twice the length of the longest of said raised portions.

19. A drill bit in accordance with claim 18 comprising a plurality of cutters, each of which extends in one of said fluid channels at its respective inlets and has a face substantially parallel to the bit's axis of rotation.

20. A drill bit in accordance with claim 19 wherein said cutters include a part extending farther outwardly relative to said side surface than said raised portions.

21. A drill bit for oil and gas wells which comprises a shaft, a cylindrical bit body affixed to said shaft, said bit body having an end surface and a side surface, said side surface including a plurality of alternating raised positions and fluid channels, a said fluid channel extending along an adjacent said raised portions for its entire length, at least one cutter having a cutting face at the mouth of each of said fluid channels, said face disposed substantially parallel to the bit's axis of rotation, the largest width of said bit body being approximately twice the outermost length of each of said adjacent raised portions.

22. A drill bit in accordance with claim 21 comprising a plurality of said cutters, each of said cutters being disposed in said channels at its respective mouth and having a cutting face substantially parallel to the bit's axis of rotation.

23. A drill bit in accordance with claim 22 wherein said cutters include a part extending farther outwardly from the axis of rotation of the bit than said raised portions.

24. A drill bit for oil and gas wells which comprises a shaft, a cylindrical bit body affixed to said shaft, said bit body having an end surface and a side surface, said side surface including an even number of raised portions alternating with a like number of fluid channels defined between said raised portions, gage inserts affixed in each said raised portion, every other said raised portions having a part which is stepped inwardly proximate said end surface, said raised portions not having a said stepped inwardly part having a length substantially less than the length of the remaining said raised portions, cutters being disposed at the inlets of said channels, the largest width of said bit body being approximately twice its length measured along its vertical side area having said largest width.

25. A drill bit for oil and gas wells which comprises a shaft, a generally cylindrical bit body affixed to said shaft, said bit body having an end cutting surface and a side surface, said end cutting surface being convex, a plurality of cutters mounted on said end surface, a first set of cutters each disposed in a first circular cutting path at a first equal radius from said axis which are displaced from each other around said axis by arcs of equal degrees, a further successive set of cutters each disposed in a second circular cutting path a further equal radius from the axis of rotation of the bit farther than said first radius and which are also displaced from each other by equal degrees of arc, there being a greater number of cutters disposed along said second cutting path than said first cutting path, said cutters in said second cutting path being closer together as measured along said second cutting path than said cutters in said first cutting path as measured along said first cutting path, said side surface including a plurality of alternating raised portions and fluid channels defined between said raised portions, the width of each said channel being approximately twice the width of each said raised portion.

26. A drill bit in accordance with claim 25 wherein there are five said raised portions.

27. A drill bit in accordance with claim 26 wherein another set of cutters are provided to extend from said side surface between the ends of said raised portions and said convex surface.

28. A drill bit in accordance with claim 27 wherein a portion of the surface of said bit body disposed between said convex surface and said side surface coincides with the surface of a truncated cone having its axis coincident with the bit's axis of rotation.

29. A drill bit in accordance with claim 28 wherein one said cutter is affixed to said convex surface to rotate proximate said axis of rotation and said other sets of cutters are disposed in successive circular paths from said axis of rotation including said first and second paths to and including a path traced by cutters extending from said conical surface, all said paths overlapping and the cutters in each said path being disposed apart by equal degrees of arc.

30. A drill bit for oil wells and the like comprising a shaft, a bit body affixed to said shaft, said bit body having a continuous cutting surface across the lower end and a side surface, junk slots disposed in said side surface, a plurality of jet openings in said cutting surface, a fluid entrance opening through the center of said shaft and bit body connecting to said jet openings for delivering drilling mud thereto, and screening means mounted in said opening for preventing the passage of junk in drilling mud from said channel to said jet openings.

31. A drill bit for oil and gas wells which comprises a shaft, a cylindrical bit body affixed to said shaft, said bit body having an end surface and a side surface, said end surface comprising a convex cutting surface which is surrounded by a peripheral portion coinciding in part with a surface of a cone having its apex and longitudinal axis coinciding with the bit's axis of rotation, said side surface including a plurality of alternating raised portions and fluid channels defined between said raised portions, a plurality of cutters mounted on said end surface, one said cutter disposed to rotate proximate the bit's axis of rotation, a first set of cutters each disposed at a first equal radius from said axis and every cutter in said first set displaced from its adjacent cutter or cutters in said first set by equal arcs around said axis, and further successive sets of cutters, the cutters in each said set being disposed further radii equal in each said set and all cutters in each respective set being displaced from its adjacent cutter or cutters in its said set by substantially equal arcs in each set around said axis, said cutters tracing circular cutting paths around said axis which overlap and substantially cover the entire area of said end surface.

* * * * *